US010144560B2

(12) United States Patent
Mutterle

(10) Patent No.: US 10,144,560 B2
(45) Date of Patent: Dec. 4, 2018

(54) CLOSURE ASSEMBLY FOR BOTTLE, ASSOCIATED BOTTLE AND ASSEMBLY METHOD

(71) Applicant: Antonio Mutterle, Breganzona (CH)

(72) Inventor: Antonio Mutterle, Breganzona (CH)

(73) Assignee: ALTERGON SA, Lugano (CH)

( * ) Notice: Subject to any disclaimer, the term of this patent is extended or adjusted under 35 U.S.C. 154(b) by 291 days.

(21) Appl. No.: 15/100,064

(22) PCT Filed: Nov. 28, 2014

(86) PCT No.: PCT/EP2014/075977
§ 371 (c)(1),
(2) Date: May 27, 2016

(87) PCT Pub. No.: WO2015/082354
PCT Pub. Date: Jun. 11, 2015

(65) Prior Publication Data

US 2018/0141729 A1 May 24, 2018

(30) Foreign Application Priority Data

Dec. 2, 2013 (IT) ..... MI2013A2005

(51) Int. Cl.
*B65D 51/00* (2006.01)
*B65D 51/28* (2006.01)

(52) U.S. Cl.
CPC ..... *B65D 51/002* (2013.01); *B65D 51/2807* (2013.01); *B65D 2101/0023* (2013.01)

(58) Field of Classification Search
CPC ..... B65D 51/002; B65D 51/2807; B65D 2101/0023
USPC ..... 215/341, 249
See application file for complete search history.

(56) References Cited

U.S. PATENT DOCUMENTS

| | | | |
|---|---|---|---|
| 5,819,964 | A | 10/1998 | Grimard |
| 5,992,660 | A | 11/1999 | Miura et al. |
| 2012/0187072 | A1 | 7/2012 | Belle |
| 2012/0248057 | A1 | 10/2012 | Bogle et al. |

(Continued)

FOREIGN PATENT DOCUMENTS

| | | | |
|---|---|---|---|
| EP | 0 909 719 | A1 | 4/1999 |
| FR | 2 927 316 | A1 | 8/2009 |
| JP | 7-165252 | A | 6/1995 |

(Continued)

OTHER PUBLICATIONS

International Search Report dated Feb. 26, 2015 in PCT/EP2014/075977 filed on Nov. 28, 2014.

*Primary Examiner* — Andrew Perreault
(74) *Attorney, Agent, or Firm* — Oblon, McClelland, Maier & Neustadt, L.L.P.

(57) ABSTRACT

A closure assembly for a bottle including a cage, a closure cap, and a sealing nut. The cage includes a side wall with an inner surface including a first annular relief and a second annular relief spaced so as to form a seat for a collar of the bottle. The closure cap includes a head and a shank. The sealing nut includes a side wall. The inner surface of the side wall of the cage includes one or more retaining teeth for retaining the head of the closure cap. The retaining teeth are cantilevered and inclined with respect to the inner surface of the side wall of the cage. Opposite the retaining teeth a recess is provided within which the teeth can be retracted, so that the head of the sealing cap can be pushed towards the base of the cage.

13 Claims, 14 Drawing Sheets

(56) References Cited

U.S. PATENT DOCUMENTS

2013/0312373 A1 11/2013 Bogle et al.

FOREIGN PATENT DOCUMENTS

| | | | |
|---|---|---|---|
| WO | 2005/000703 | A2 | 1/2005 |
| WO | 2011/039004 | A1 | 4/2011 |
| WO | 2012/152796 | A1 | 11/2012 |

CLOSURE ASSEMBLY FOR BOTTLE, ASSOCIATED BOTTLE AND ASSEMBLY METHOD

The present invention relates to the sector of closure systems for sealingly closing a container, for example a bottle. In particular, the invention relates to a closure assembly for a bottle or a similar container. The present invention also relates to a container, in particular, but not exclusively a bottle provided with a closure assembly. The invention also relates to an associated assembly method. The invention is applicable to bottles containing freeze-dried products, for example freeze-dried medicinal products, or powders, liquids or the like.

PRIOR ART

For the sake of simplicity, the present invention will be described substantially only with reference to a particular type of container, i.e. a bottle. However, the present invention is not limited only to these containers and the choice of referring only to bottles is not to be understood in any way as limiting the scope of protection of the invention.

Moreover, although a possible area of application is the pharmaceutical sector, the present invention is likewise applicable to other (related or different) sectors, for example the cosmetics sector, the food sector, the sector of food supplements or any other sector where a substance must be packaged inside a container (in any state, for example a solid, liquid, freeze-dried, gel or other state) in a safe and sealed manner.

US 2012/248057 A1 discloses a capping system and method of use for sealing injectable drugs within vials. The system includes a closure assembly and a locking cap. The closure assembly includes a retainer member and a resilient stopper located within the retainer member. The retainer member is arranged to be disposed on the vial whereupon a gap results between the stopper and the vial. The retainer member is movable to close that gap. The locking cap is used to permanently seal the vial.

EP 0 909 719 A1 discloses a closure for vial container in which the shift of a semi-stopping freeze-drying posture to a full-stopping posture can be smoothly effected, the full-stopping posture can be firmly kept, and forgery of the contained drug cannot be done at all.

JP H07 165252 A discloses a vial container.

U.S. Pat. No. 5,819,964 A discloses a lyophilization closure assembly for a medicament container for use during a lyophilization process.

WO 2011/039004 discloses a locking cover for a vessel having a neck, including a cap having attachment tabs.

WO 2012/152796 A1 and FR 2,927,316 describe a closure assembly for a bottle. In both the solutions, the assembled closure assembly is associated with the bottle by inserting the closure cap inside the mouth of the bottle.

WO 2005/000703 A2 describes a closure assembly for a freeze-drier.

BRIEF SUMMARY OF THE INVENTION

The inventor has noted that none of the known solutions envisages associating in a stable and reliable manner a cage with the collar of a bottle and a sealing nut with the cage.

In particular, the capping system according to U.S. 2012/248057 A1 does not envisage a seat for locking a retainer member to the neck of a bottle; it envisages only upper tabs (26F). The capping system does not have a lid of the flip-off type and is designed to be moved on trays where the bottles occupy predetermined positions and are not in contact with each other.

The closure for vial container of EP 0 909 719 A1 comprises engaging plates which are inclined upwardly and fail to provide a seat with lower protrusions 60.

The Applicant has established experimentally that, during the operations which precede sealing of the bottle according to the solutions described in WO 2012/152796 A1 and in FR 2,927,316, the closure assembly inserted into the mouth of the bottle is not stable and is not straight. Therefore, the Applicant has established that, on various occasions, the closure assembly comes off the mouth of the bottle and falls. In fact, during transportation from the filling line to the freeze-drier, for example, both via an automatic conveyor belt and via trays inserted manually, vibrations are inevitably generated and these may easily result in the closure assembly falling off. This results in the bottle no longer being able to be used. In particular, when a closure assembly comes away from the bottle and falls to the ground it is no longer possible to use the substance introduced inside the bottle, said substance having to be discarded, with consequent economic loss. Incorrect positioning of the assembly, moreover, could even result in breakage of the bottle itself, with consequent contamination of the other bottles present which would have to be washed in order to safeguard the health of persons who are required to work, in some cases, with highly active substances. All of this results in anomalous operations along the production line with a consequent interruption in the bottle closing process, resulting in lower productivity with the associated economic loss.

The main drawback, instead, of the solution described in WO 2005/000703 A2 is that the sealing cap is not properly held in position by the cage, but may fall to the ground during movement thereof, with all the drawbacks mentioned above in connection with WO 2012/152796 A1 and FR 2,927,316. Moreover, the diameter of the closure assembly according to WO 2005/000703 A2 is greater than the diameter of the bottle and this creates major problems during assembly, during the freeze-drying steps, labeling, storage and transportation of the bottles, making use thereof during production impossible.

The Applicant has defined the objective of providing a simple and reliable closure assembly which is stable when associated with the mouth of a bottle so that the risk that said assembly (or even only one of its components) falling is reduced as far as possible or more or less eliminated.

According to one aspect, the present invention provides a closure assembly with a cage configured so as to have a seat for stable engagement with the collar of a bottle and a device for retaining a sealing cap and preventing it from separating from the cage.

According to a first aspect, the present invention provides a closure assembly for a bottle comprising a cage, a closure cap and a sealing nut, wherein:

- said cage is substantially cup-shaped and comprises a side wall with an inner surface comprising a first annular relief and a second annular relief spaced so as to form a seat for a collar of the bottle;
- said closure cap comprises a head and a shank, wherein said head comprises an upper surface and an opposite annular surface;
- said sealing nut is cup-shaped and comprises a side wall;
- the inner surface of the side wall of the cage comprises a retaining tooth for retaining in position the head of the closure cap along said annular surface;

said retaining tooth is cantilevered and is inclined with respect to the inner surface of the side wall of the cage;

at said retaining tooth a recess is provided within which the tooth can be retracted, so that the head of the sealing cap can be pushed towards the base of the cage;

the outer surface of the side wall of the cage comprises an annular cavity;

the side wall of the sealing nut comprises an inner lower protuberance configured to engage with the annular cavity; and the side wall of the cage comprises a plurality of discrete side walls, each separated by a slit, wherein a discrete side wall is connected to an adjoining discrete side wall with a bridge-piece in the proximity of their free end.

In this way, the sealing nut may be kept stable with respect to the cage, which is in turn stable with respect to the collar of the bottle, in a preassembly configuration.

Preferably four retaining teeth and four respective recesses are provided.

In embodiments, the free end of said discrete side walls has a beveled shape.

In embodiments the sealing cap is configured in such a way that the shank is at least partially inserted into the mouth of the bottle when the bottle collar is between the first annular relief and the second annular relief.

Preferably, the assembly comprises a lid with an engaging part for engaging with an edge of a central opening in the upper base of the sealing nut.

In embodiments, the engaging part comprises a foot with an annular heel.

The free edge may be folded so as to form a rounded edge.

The sealing nut may comprise a free edge folded so as to form a rounded edge.

The sealing nut may comprise a metal foil and the inner lower protuberance may comprise a first annular fold which forms an annular restriction with respect to a substantially cylindrical inner surface of the sealing nut.

The sealing nut may comprise a first annular fold and a second annular fold which form two respective annular constrictions with respect to the substantially cylindrical inner surface of the sealing nut.

According to a second aspect, the present invention provides a bottle with a closure assembly of the aforementioned type. Preferably, the outer diameter of the bottle is greater than, or the same as, the outer diameter of the sealing assembly.

According to a third aspect, the present invention provides a method for assembling a closure assembly of a bottle or the like and for mounting it on the mouth of said bottle, wherein said method comprises:

providing a cage, a closure cap and a sealing nut, wherein said cage is substantially cup-shaped and comprises a side wall with an inner surface comprising a first annular relief and a second annular relief spaced so as to form a seat for a collar of the bottle;

said closure cap comprises a head and a shank, wherein said head comprises an upper surface and an opposite annular surface;

said sealing nut is cup-shaped and comprises a side wall that terminates at a folded free edge;

the inner surface of the side wall of the cage comprises a retaining tooth for retaining in position the head of the closure cap along said annular surface;

said retaining tooth is cantilevered and is inclined with respect to the inner surface of the side wall of the cage;

at said retaining tooth a recess is provided within which the tooth can be retracted, the outer surface of the side wall of the cage comprises an annular cavity;

the side wall of the sealing nut comprises an inner lower protuberance configured to engage with said annular cavity, pushing the head of the sealing cap towards the base of the cage, partially fitting said sealing nut on said cage, so that the inner lower protuberance engages with the annular cavity, mounting said cage on said bottle so that the collar of the bottle abuts between said first annular relief and said second annular relief.

Advantageously it is envisaged performing the step of providing a lid and the step of joining said lid together with said sealing nut.

Preferably the step of joining said lid together with said sealing nut is performed before partially fitting said sealing nut onto said cage.

A detailed description of the invention now follows, being provided purely by way of a non-limiting example, to be read with reference to the accompanying sets of drawings in which.

Figure 2:
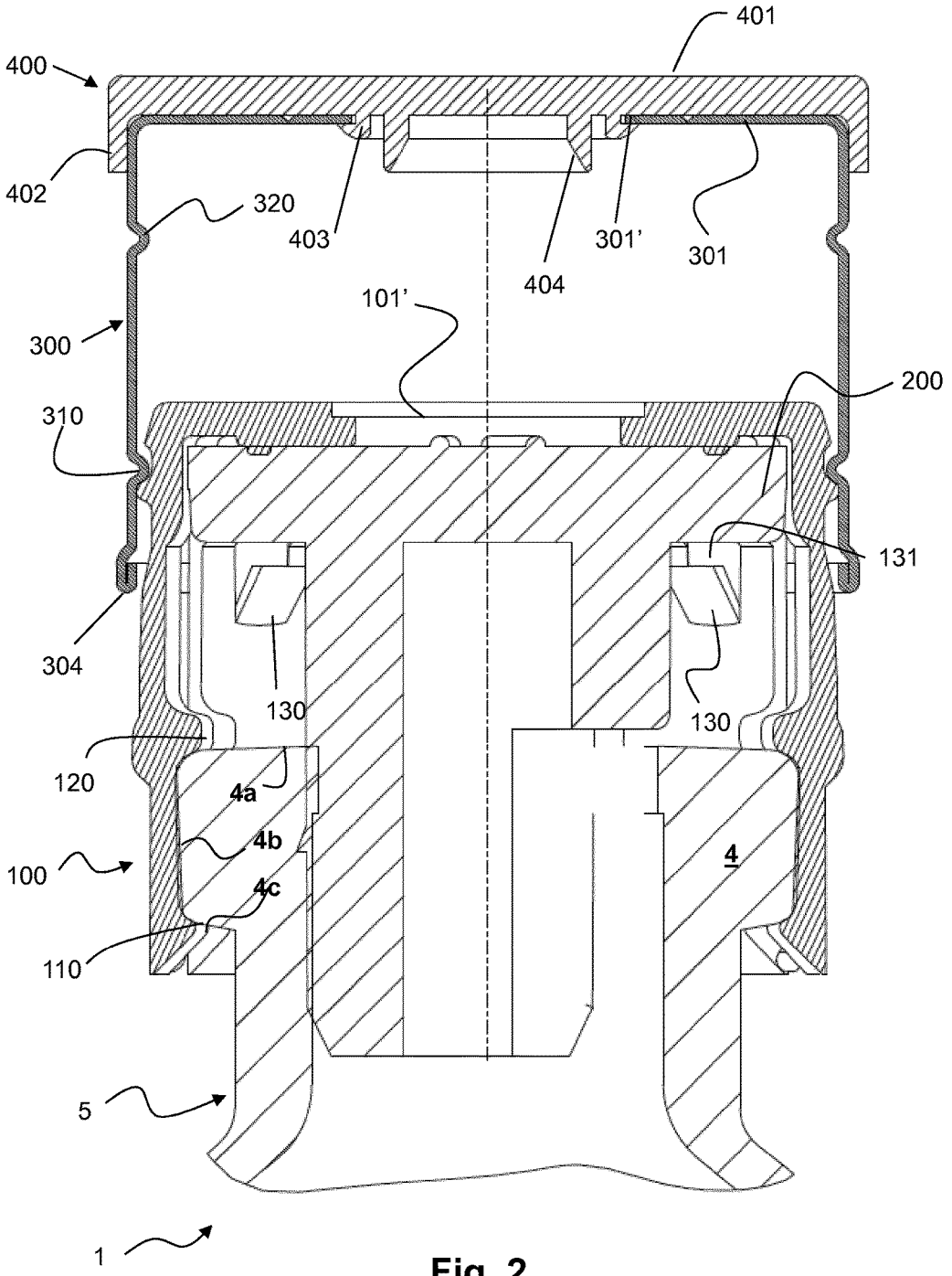
FIG. 2 shows a longitudinally sectioned view, on a larger scale, of the closure assembly according to a first embodiment of the present invention, during a preassembly step.
Figure 3:
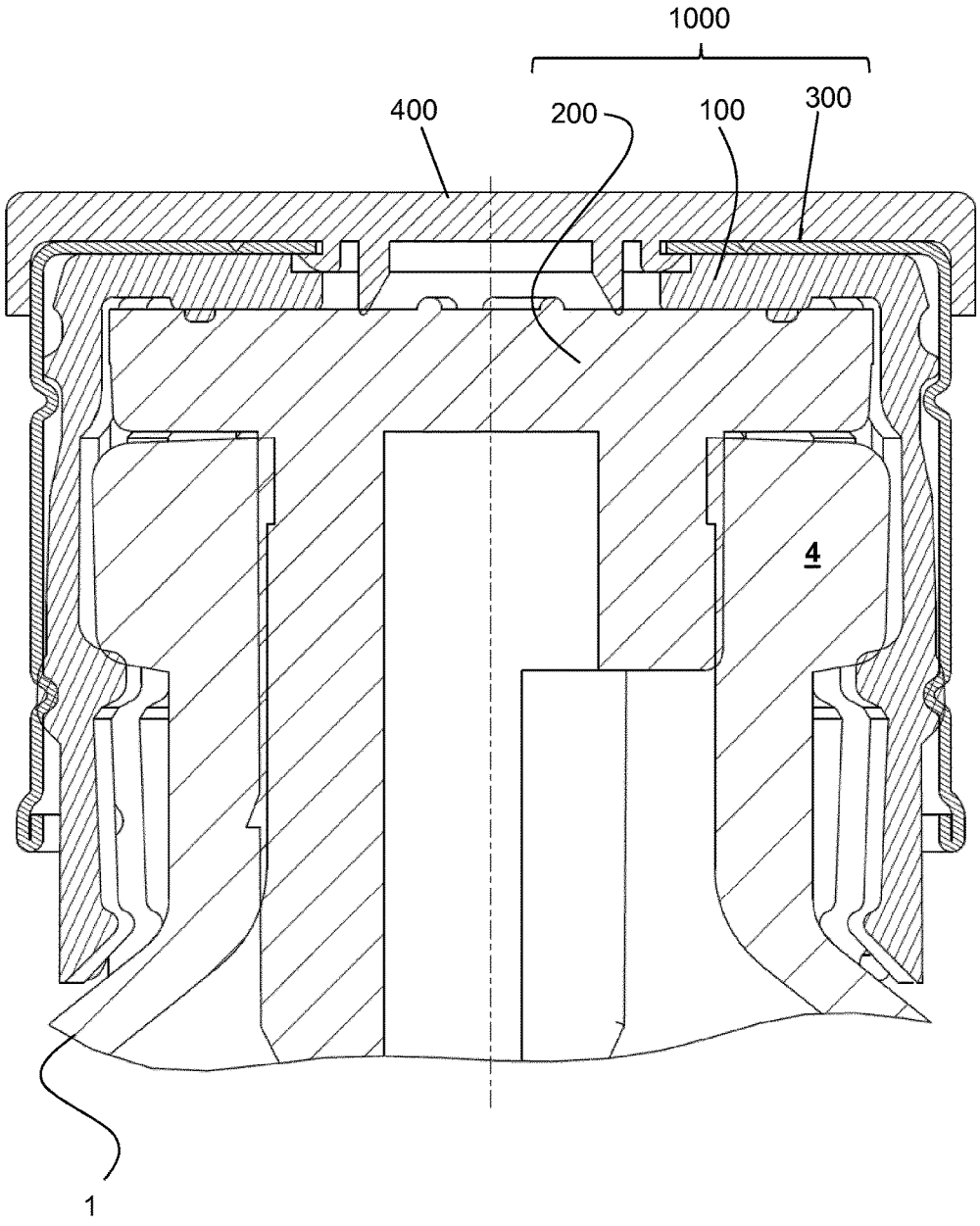
FIG. 3 shows a longitudinally sectioned view, on a larger scale, of the closure assembly according to the first embodiment of the present invention, in a closed configuration.
Figure 7:
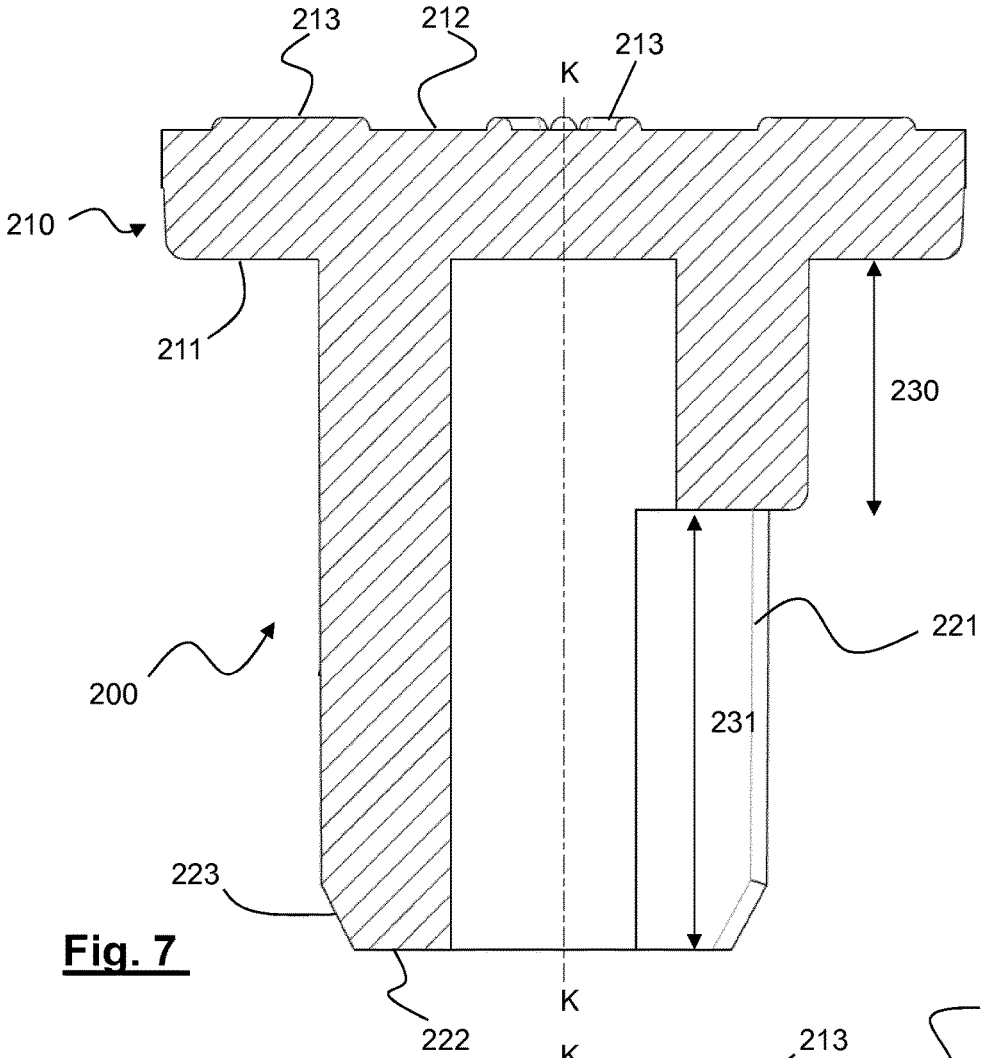
Figure 11:
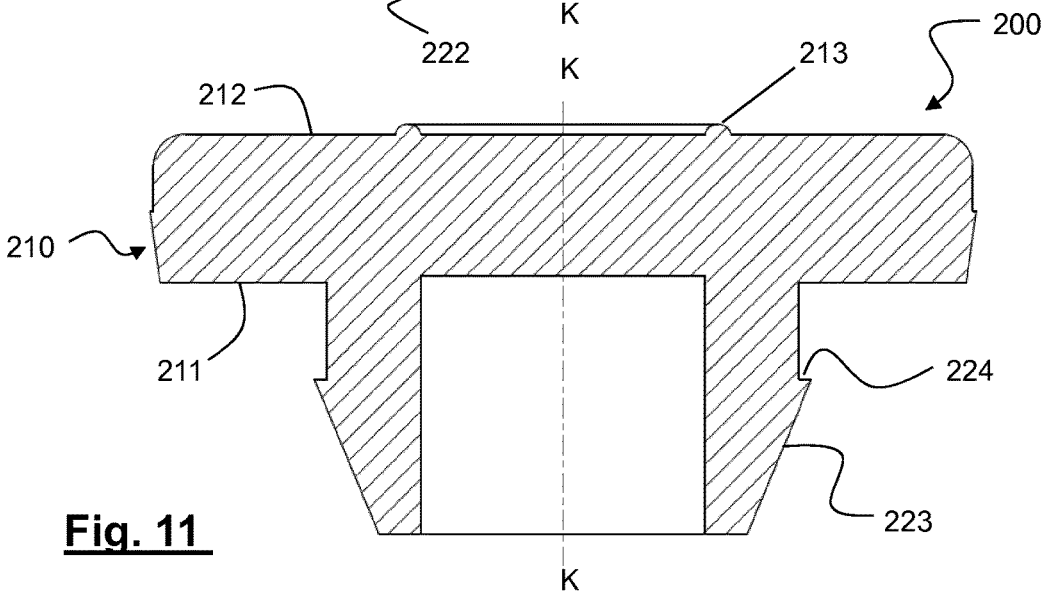
Figure 8:
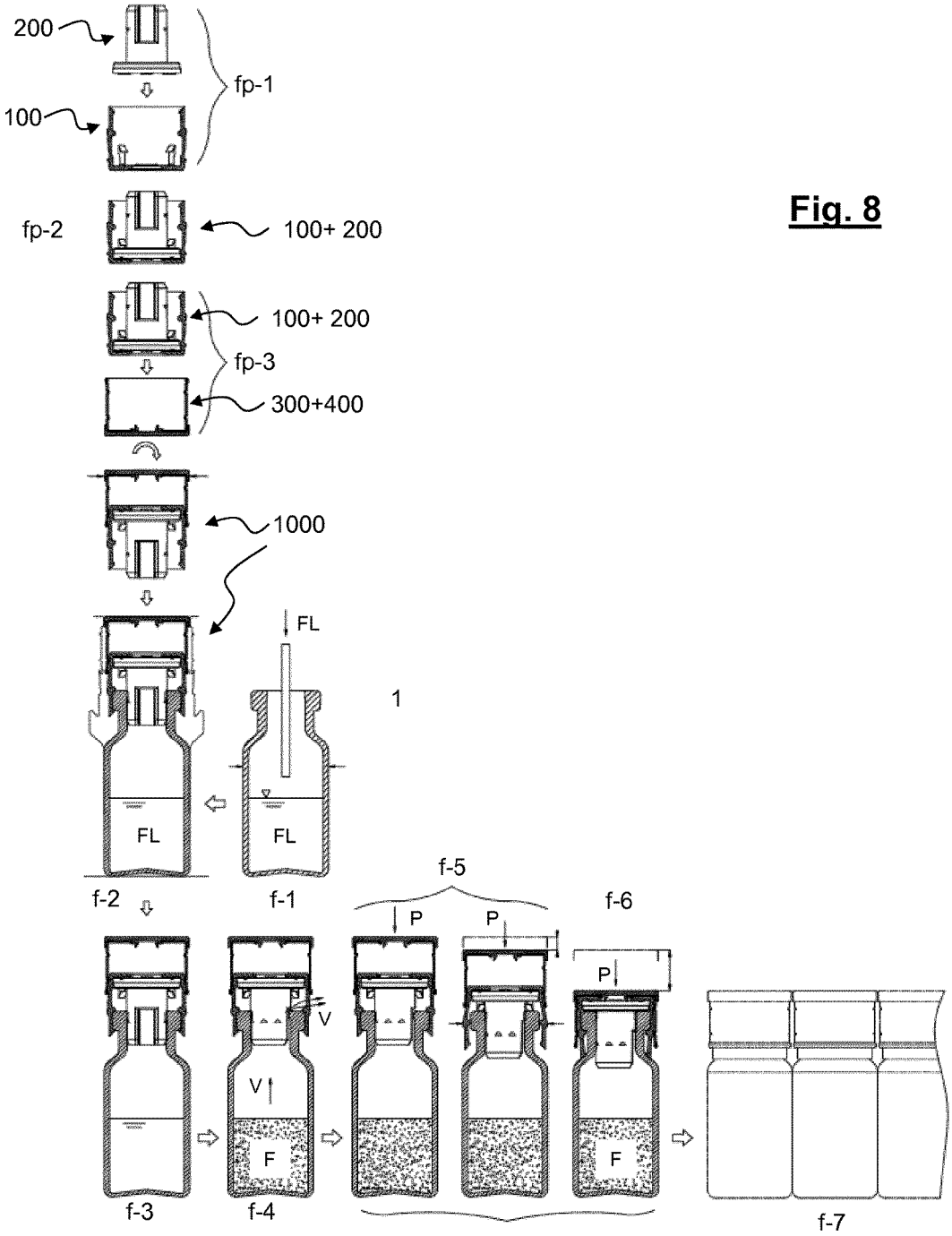
Figure 9:
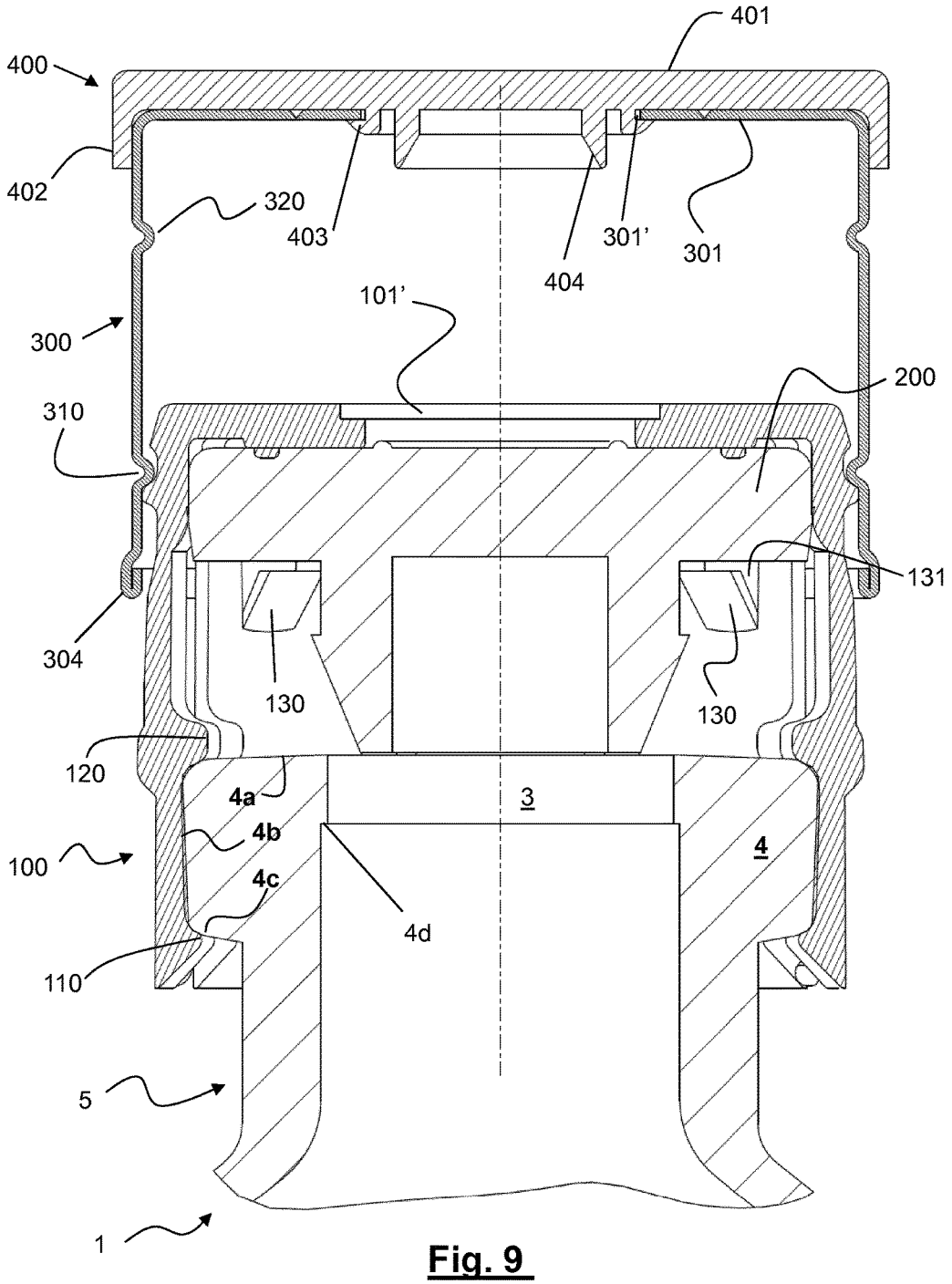
Figure 10:
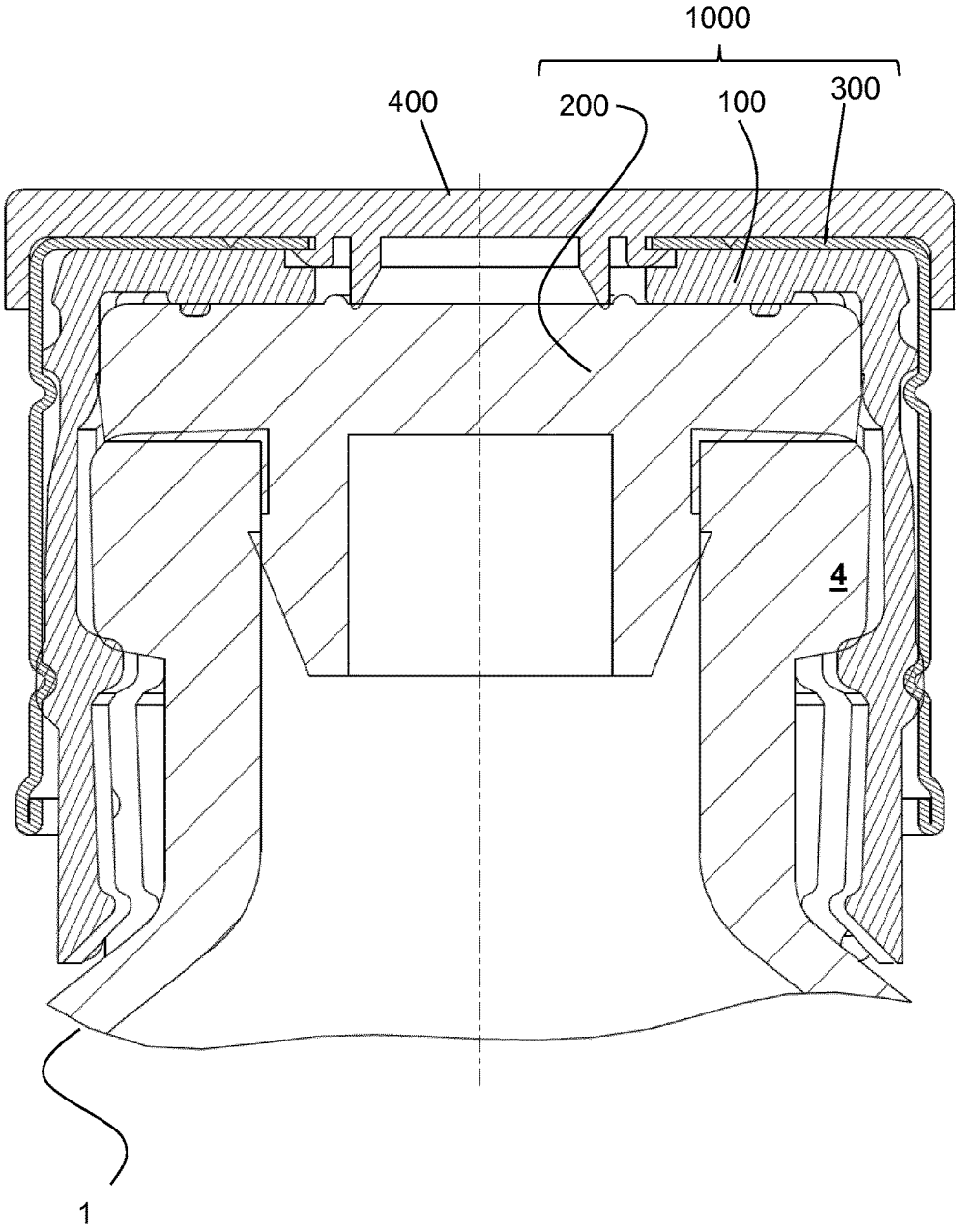
Figure 12:
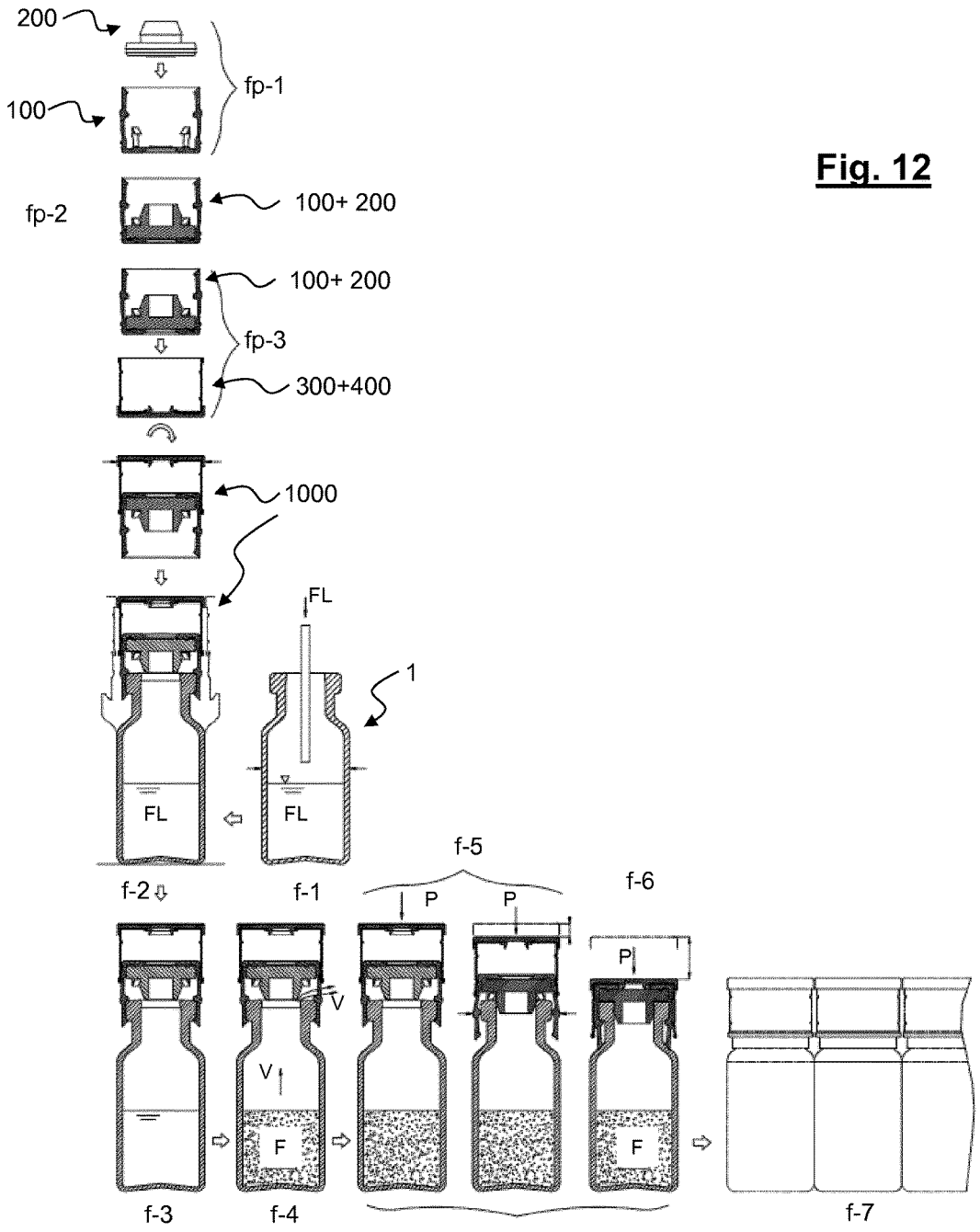
Figure 13:
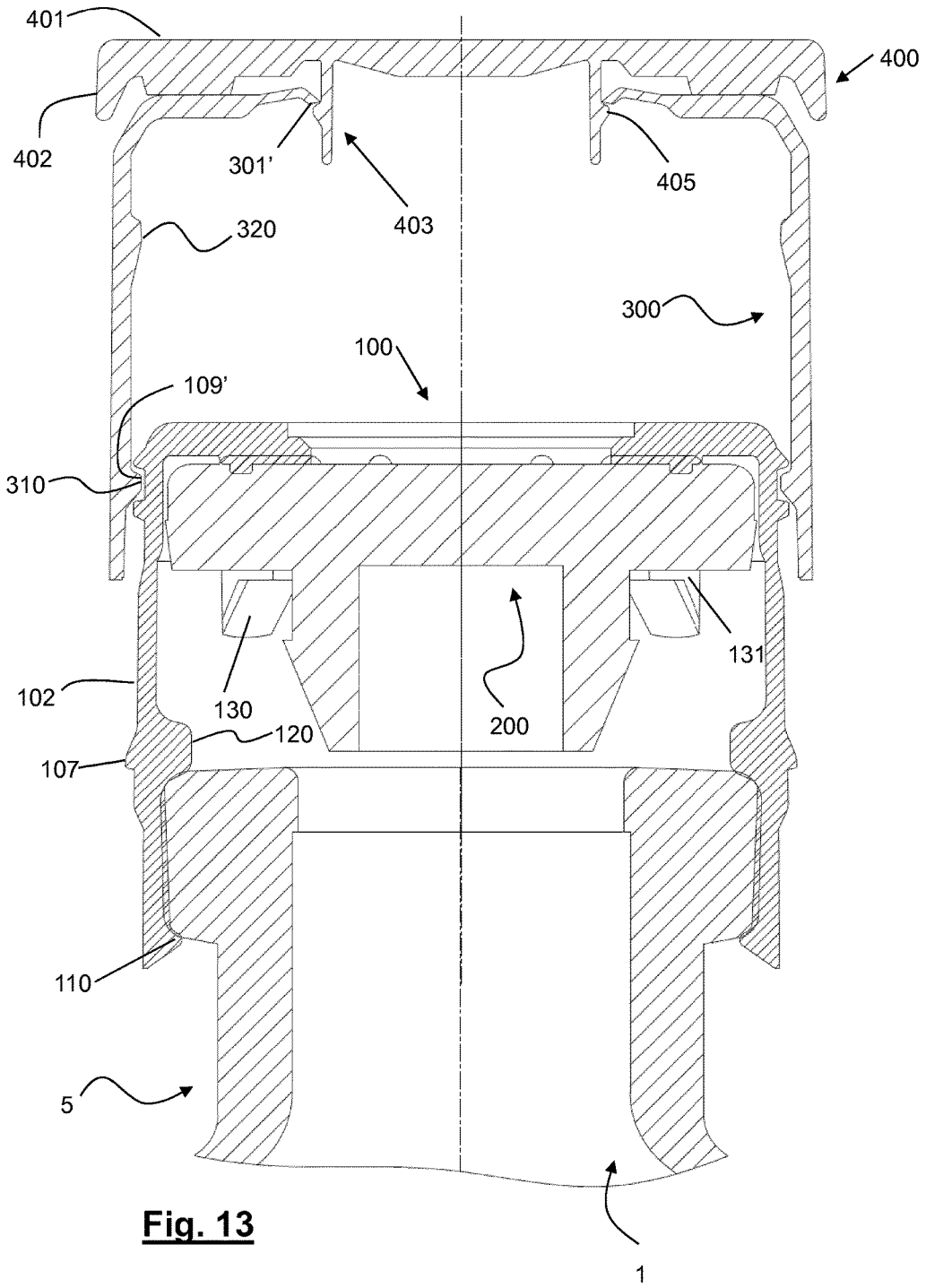
Figure 14:
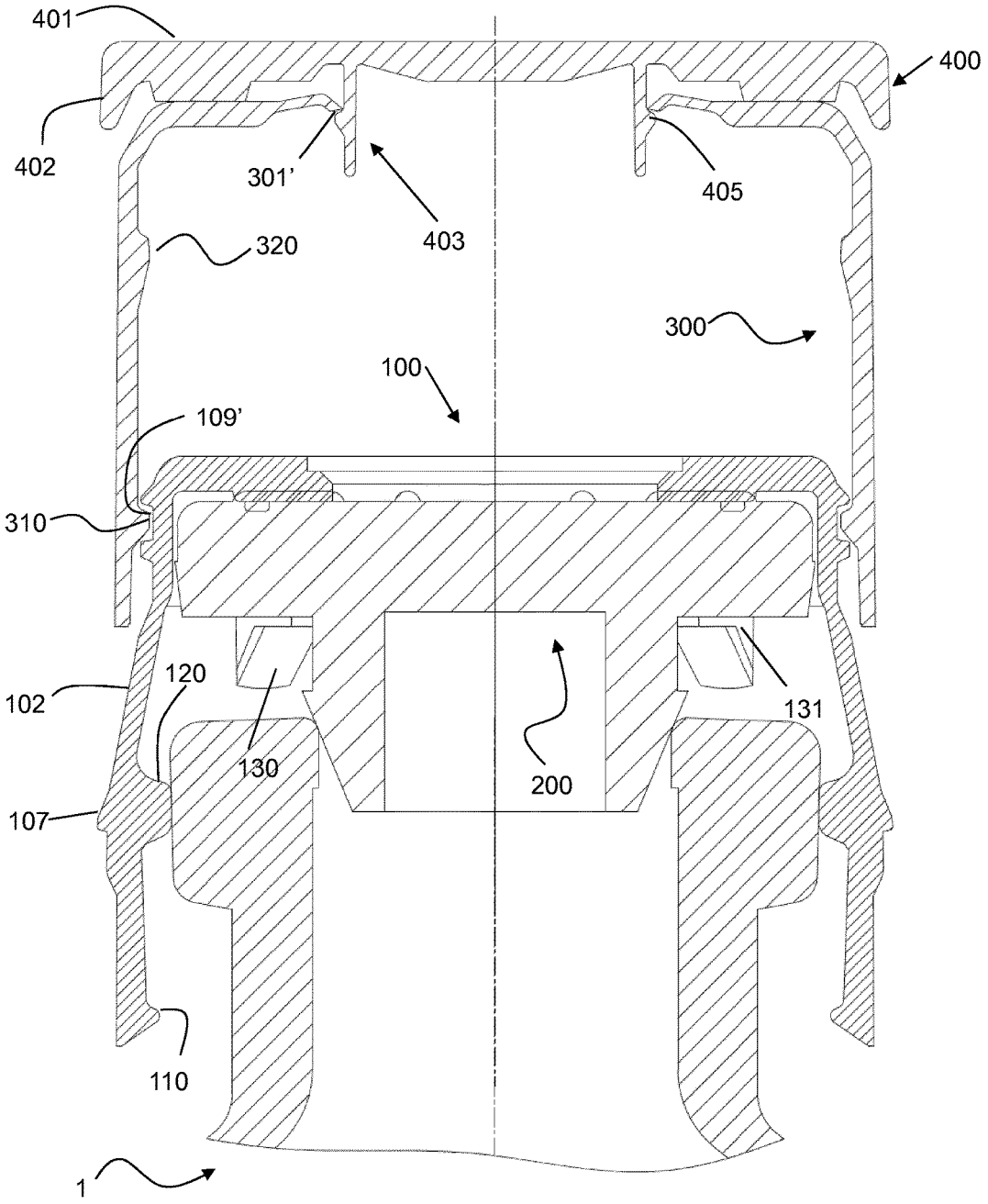
Figure 15:
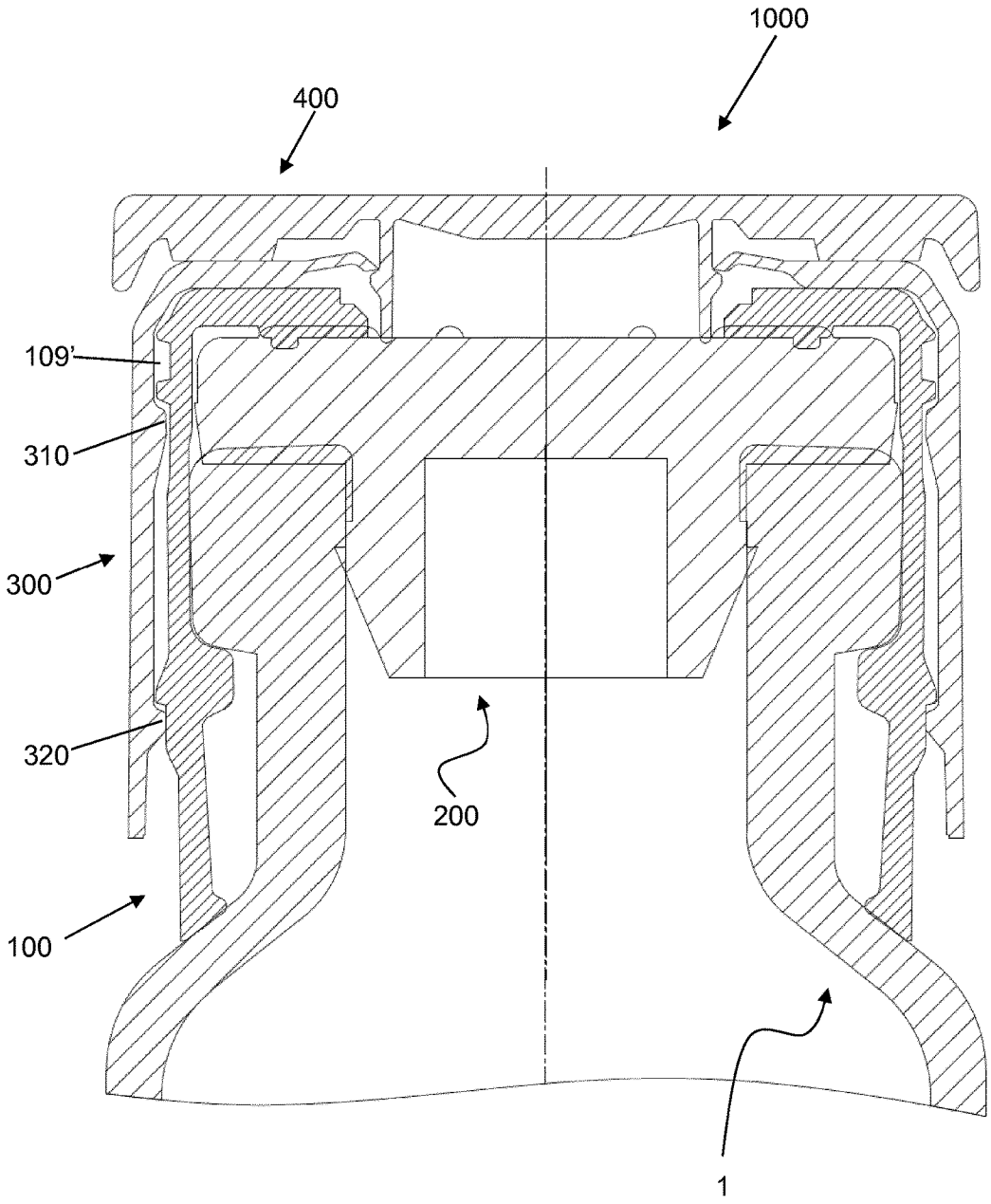
Figure 16:
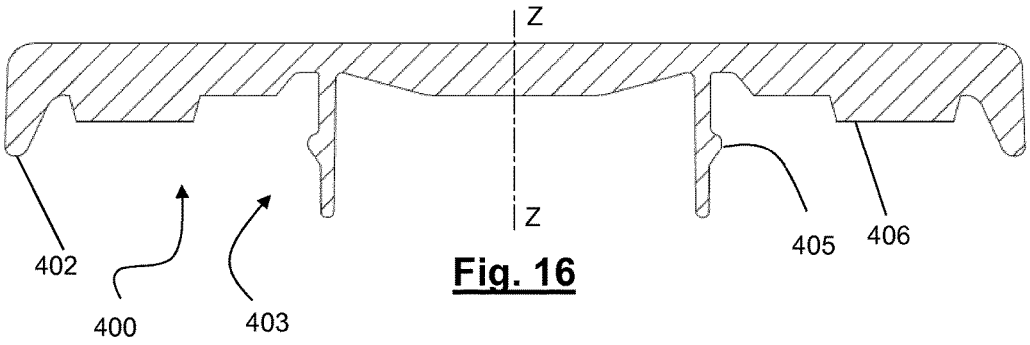
Figure 17:
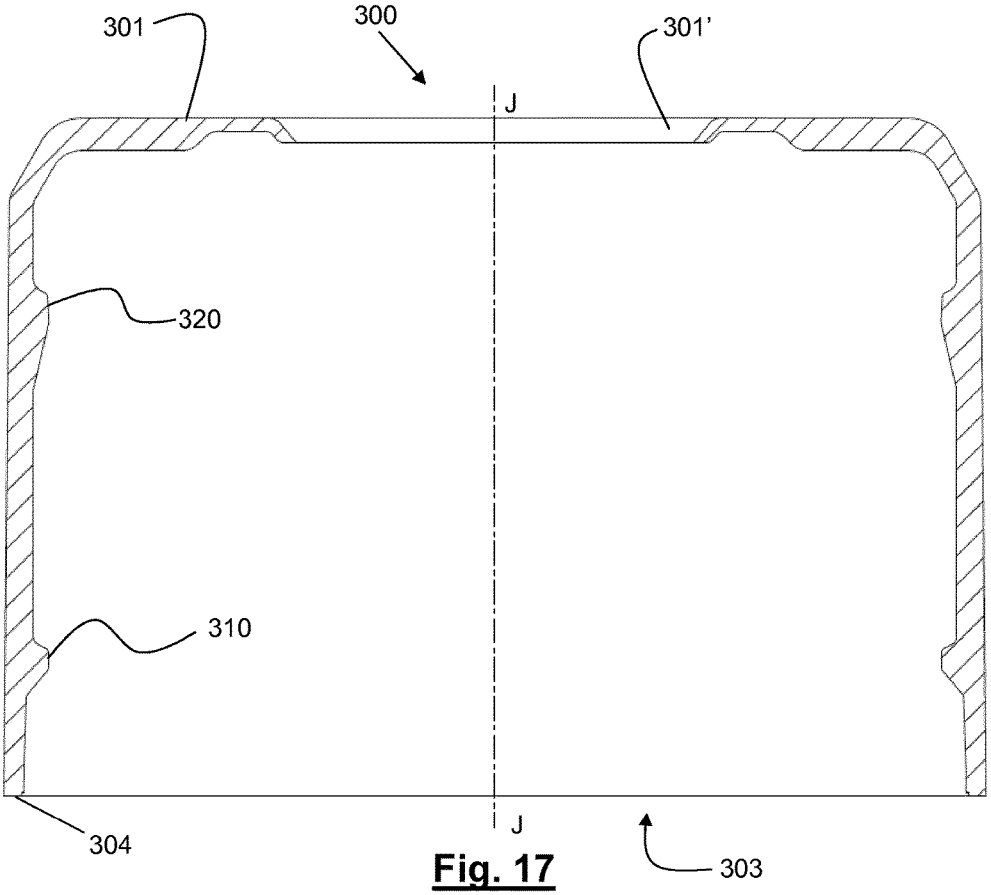

the side wall of the cage comprises a plurality of discrete side walls, each separated by a slit, wherein a discrete side wall is connected to an adjoining discrete side wall with a bridge-piece in the proximity of their free end, FIG. 7 shows a longitudinally sectioned view, on a larger scale, of a sealing nut of the closure assembly according to FIGS. 2 and 3;

FIG. 8 shows a sequence of steps for assembly of the closure assembly according to the first embodiment, filling of the bottle, closing and transportation and/or storage of filled containers;

FIG. 9 shows a longitudinally sectioned view, on a larger scale, of the closure assembly according to a second embodiment of the present invention, during a preassembly step;

FIG. 10 shows a longitudinally sectioned view, on a larger scale, of the closure assembly according to the second embodiment of the present invention, in a closed configuration;

FIG. 11 shows a longitudinally sectioned view, on a larger scale, of an example of a sealing cap of the closure assembly according to FIGS. 9 and 10;

FIG. 12 shows the sequence of steps for assembly of the closure assembly according to the second embodiment, filling of the bottle, closing and transportation and/or storage of filled containers;

FIG. 13 shows a longitudinally sectioned view, on a larger scale, of the closure assembly according to a third embodiment of the present invention, during a preassembly step;

FIG. 14 shows a longitudinally sectioned view, on a larger scale, of the closure assembly according to the third embodiment of the present invention, during an intermediate assembly step;

FIG. 15 shows a longitudinally sectioned view, on a larger scale, of the closure assembly according to the third embodiment of the present invention, in the completely closed configuration;

FIG. 16 shows a cross-section through the lid of the closure assembly according to FIGS. 13, 14 and 15; and FIG. 17 shows a cross-section through the sealing nut of the closure assembly according to FIGS. 13, 14 and 15.

In the description which follows, all the position terms, such as "top" or "upper", "bottom" or "lower", "side" or "lateral", etc., are used with reference to the figures. However, a component referred to as "top or upper" (because it is shown in a higher position than others) may be "bottom" or "lower" if overturned or rotated into another position. Therefore these terms are not to be regarded as limiting the scope of the invention. Typically, during assembly, some components may be overturned with respect to their position at the end of the assembly or during use.

Figure 1:
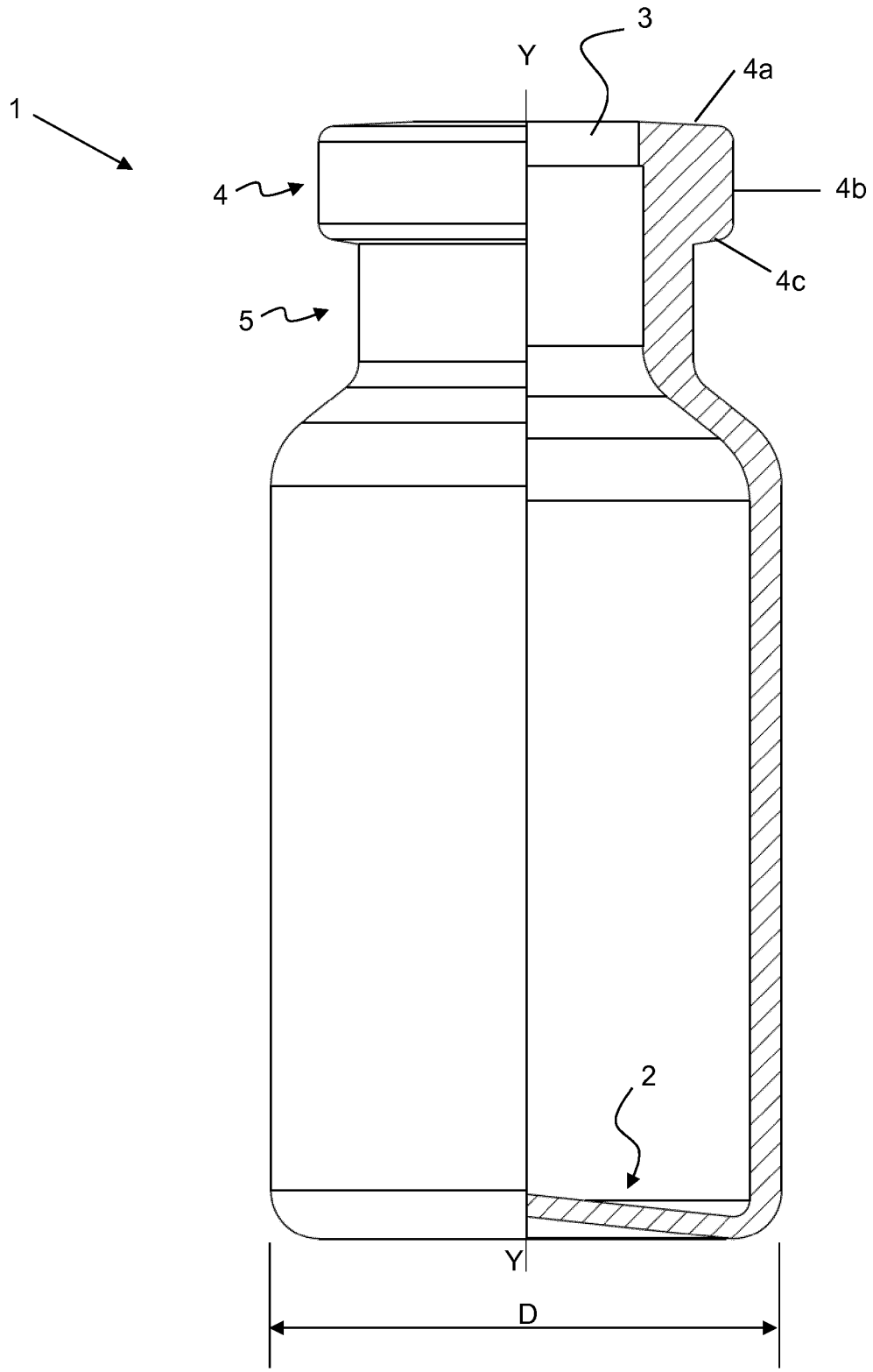
FIG. 1 shows a longitudinally sectioned view of a bottle configured to be closed by means of the closure assembly according to embodiments of the present invention.

With reference initially to FIG. 1, the bottle 1 comprises a substantially cylindrical body with a closed bottom 2 and an open mouth 3. An annular collar 4, or annular molding, which forms a swelling extending radially outwards, is preferably provided in the region of the mouth 3. A neck 5 with an outer diameter smaller than that of the collar 4 is provided below the collar 4 and is connected to the lower part of the substantially cylindrical body. Such a bottle is also conventionally referred to as a "penicillin type bottle". More precisely, as shown also in FIGS. 2 and 3, the annular collar 4 comprises a top surface 4*a* which is substantially horizontal (in reality slightly inclined downwards on the outside), a side surface 4*b* which is substantially vertical and a bottom surface 4*c* which is slightly inclined upwards on the outside. The various top, side and bottom surfaces are connected together by means of curved surfaces. Preferably, the bottle is made of glass or a plastic material, such as polyethylene, polyethylene terephthalate, PETG, PEHD or the like.

The closure assembly 1000 according to the first embodiment is shown in FIGS. 2 and 3. Below the cage 100, the sealing cap 200, the sealing nut 300 and the protection and sealing lid 400 will be separately described. Thereafter the mutual relationship of the various components and how to assemble them will be described.

Figure 4:
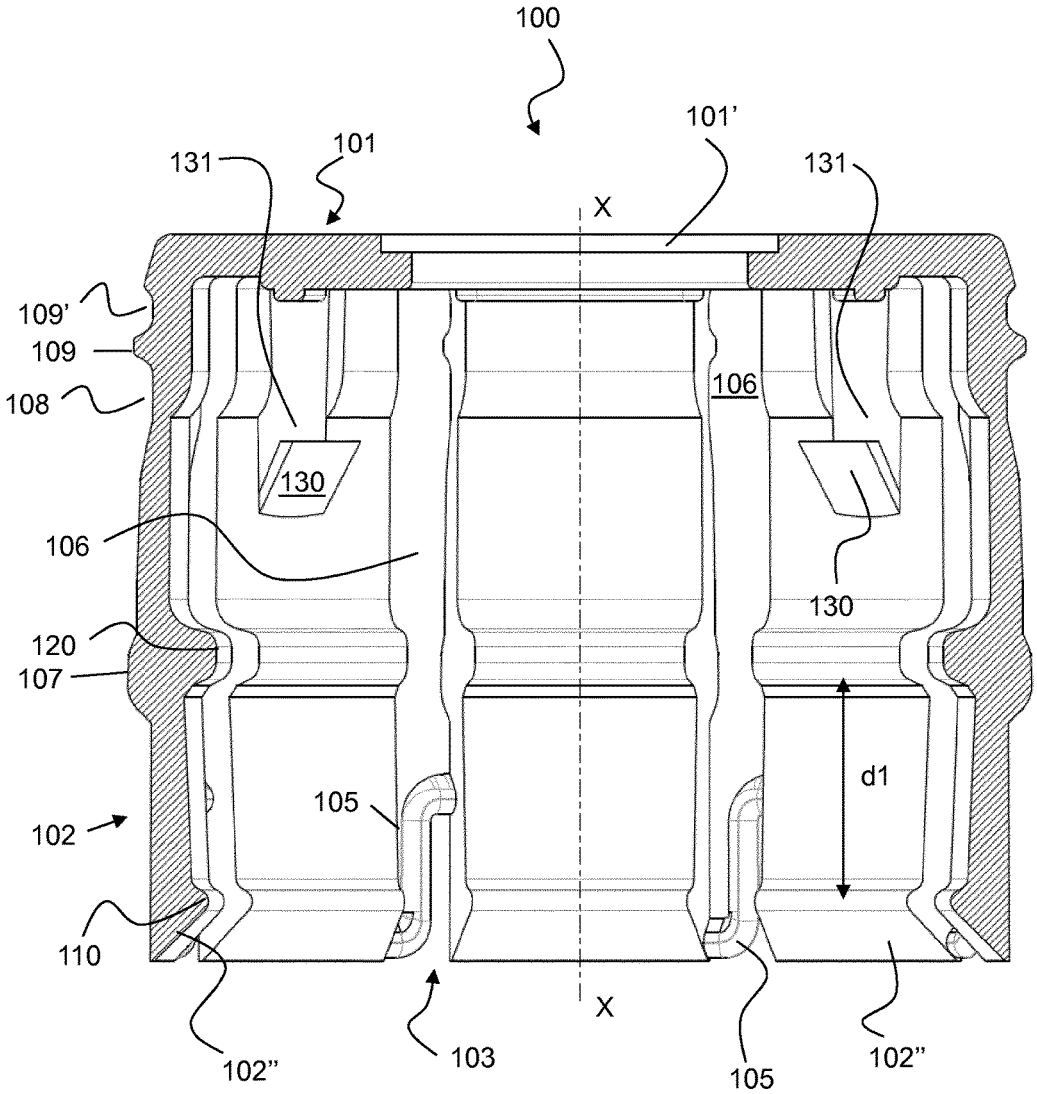
FIG. 4 shows a longitudinally sectioned view, on a larger scale, of a cage of the closure assembly according to FIGS. 2 and 3.

With reference to FIGS. 2, 3 and 4 the cage 100 will be described. The cage 100 is in the form of a body having a shape of an overturned cup with a closed upper base 101 (except for an opening 101' which will be described below), a side wall 102 and an open lower base 103. Preferably, the side wall 102 is divided up into a plurality of substantially parallel discrete side walls 102' (or wings 102') which are connected together at the closed base 101. In preferred embodiments, the free ends of the discrete side walls 102' are also loosely connected together by means of a thin "S" or "U" shaped cord 105.

These cords (or bridge-pieces) have an extremely important function as regards the functionality of the entire assembly. A first characteristic feature of the bridge-pieces 105, in fact, is that of providing the assembly with elasticity, thus ensuring a firm sealing action thereof during pre-engagement onto the bottle. A second positive aspect instead arises during the step of capping the bottles inside the freeze-drier. During this operation, in fact, the bottles are arranged next to each other, and therefore when the assembly is pushed downwards, the petals 102', since they have to pass over the circumference of the bottle collar, if the bridge-pieces were not present would flare outwards and interfere with each other, thus creating a series of problems. The presence of the bridge-pieces 105, instead, allows the petals 102' to maintain, during each capping step, a smaller size than the diameter of the bottle body. Preferably, the free ends 102" of the discrete side walls 102' are tapered. A slit 106 is present between each wing. According to a preferred embodiment, the side wall is divided into eight discrete side walls 102'.

Preferably the inner surface of the side wall 102 of the cage 100 comprises a lower annular relief 110 and an intermediate annular relief 120. The lower annular relief 110 preferably is situated in the vicinity of the free end 102" of the vertical wall 102 and forms, in cross-section, a kind of nose projecting radially towards the axis X-X of the cage 100. The intermediate annular relief 120 is situated at a distance d1 from the lower annular relief 110. The distance d1 corresponds substantially to the length of the side surface 4*b* of the annular collar 4 of the bottle 1. The curved surfaces of the annular collar 4 also substantially correspond to the curved surfaces of the lower annular relief 110 and the intermediate annular relief 120. As will be clear below, owing to the two annular reliefs 110, 120, their form and their relative distance, the cage 100 may be fitted onto the bottle 1 in a stable and precise manner, such that the axis X-X of the cage substantially coincides with the axis Y-Y of the bottle.

The outer surface of the side wall 102 comprises a first lower portion with a roughly constant cross-section, a knee 107 (substantially opposite the intermediate annular relief 120), a second upper portion which tapers towards the upper base 101, an annular spur 109 and an annular cavity 109'.

Preferably, the inner surface of the side wall 102 of the cage 100 comprises one or more flexible retaining teeth (for example four teeth) 130 for retaining in position the head of the cap 200 which will be described below. Each retaining tooth 130 is cantilevered and is inclined with respect to the inner surface of the side wall 102 of the cage 100. Preferably, a recess 131 within which the tooth 130 can be retracted is provided for each tooth 130. In this way, as will be clear below, the head of the cap 200 may be pushed towards the base 101 of the cage 100 and retained in the correct position. During this step the teeth 130 retract elastically inside the respective recesses 131 and then return in their initial projecting position. If necessary the form of the aforementioned teeth 130 may be modified such that, in addition to retaining the cap, they may also ensure the centering thereof inside the cage 100 so as to allow their correct positioning on the bottle mouth.

Preferably, the upper base 101 of the cage comprises a hole 101'. Preferably, the hole 101' in the upper base of the cage is a central circular hole.

Preferably, the cage 100 consists of thermoplastic material and is made by means of injection-molding as one piece. A suitable material is, for example, polyethylene, polyethylene terephthalate, PETG, PEHD or ABS (acrilonitrile butadiene styrene).

With reference to FIGS. 2, 3 and 7 the sealing cap 200 according to a first embodiment will now be described. The sealing cap 200 of the stopper type comprises a head 210 and a long shank 220. The head 210 is preferably in the form of a thick disc. The shank 220 is preferably cylindrical, internally hollow and with a split 221 which extends along a certain length (231) from the free end 222 of the shank 220. Preferably the free end 222 of the shank is tapered (223) as shown in FIG. 2 and FIG. 3. Preferably the sealing cap 200 is made of rubber or a similar material. The cap 200 forms a sealing surface 211 designed to cooperate with the top surface 4*a* of the collar 4 of the bottle 1 in order to ensure the sealing action. Preferably, the head 210 of the cap 200 has a top surface 212 which is substantially flat with raised parts 213.

Figure 5:
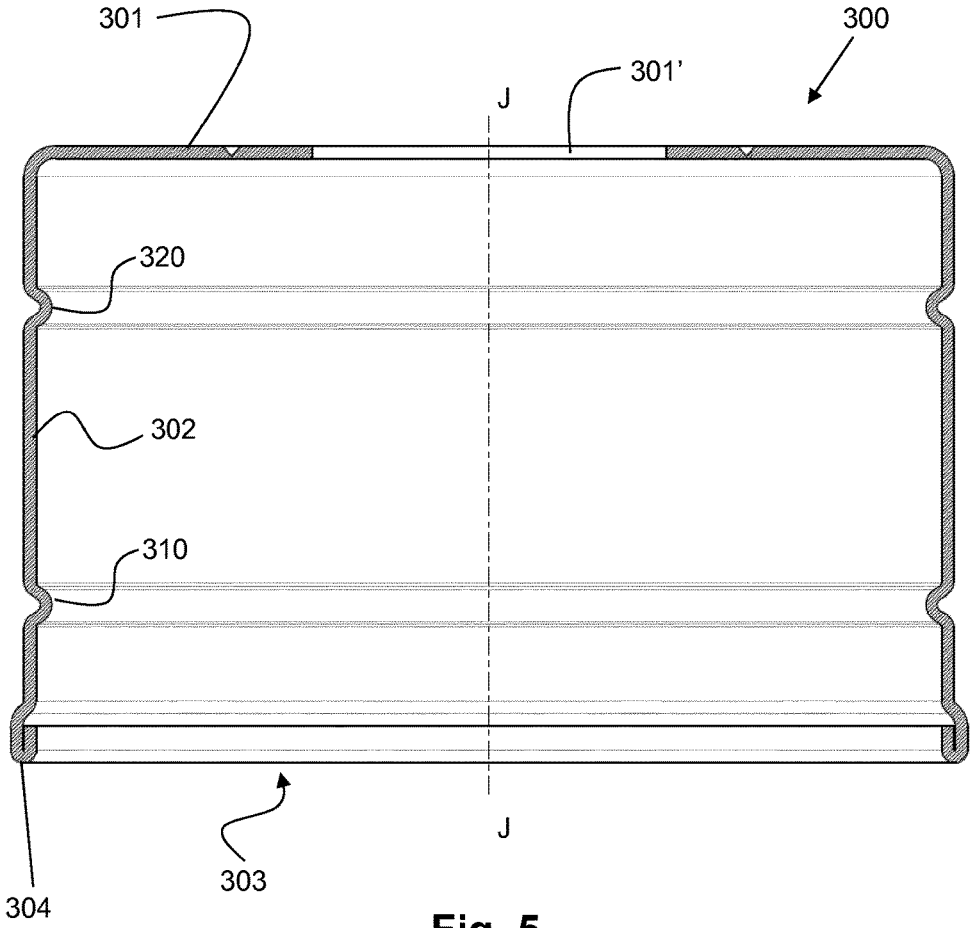
FIG. 5 shows a longitudinally sectioned view, on a larger scale, of a sealing nut of the closure assembly according to FIGS. 2 and 3.

With reference to FIGS. 2, 3 and 5 the sealing nut 300 will now be described. The sealing nut 300 has preferably the form of an overturned cup with an upper base 301 which is substantially closed, a side wall 302 and a lower base 303 which is open downwards. Preferably, the sealing nut 300 is formed by a thin foil of metallic material such as aluminum or aluminum alloy. Plastic materials could, however, also be used.

Preferably, the side wall 302 of the sealing nut 300 terminates in a folded edge 304. This feature is particularly advantageous since it avoids having a cutting edge, which could be dangerous for those handling the sealing nut or bottle once it has been sealed. Moreover, advantageously, the folded edge 304 avoids the presence of burrs and metallic fragments, which are particularly dangerous in any environment, but in particular in sterile environments for the production of pharmaceutical products.

Preferably, according to the first embodiment, the side wall 302 of the sealing nut 300 comprises a first, bottom, annular fold 310 and a second, top, annular fold 320 which form two respective annular constrictions with respect to the substantially cylindrical inner surface of the sealing nut 300. The function of the annular folds 310, 320 will be explained below Preferably, the upper base 301 of the sealing nut comprises a central opening 301', which is advantageously substantially circular.

Figure 6:
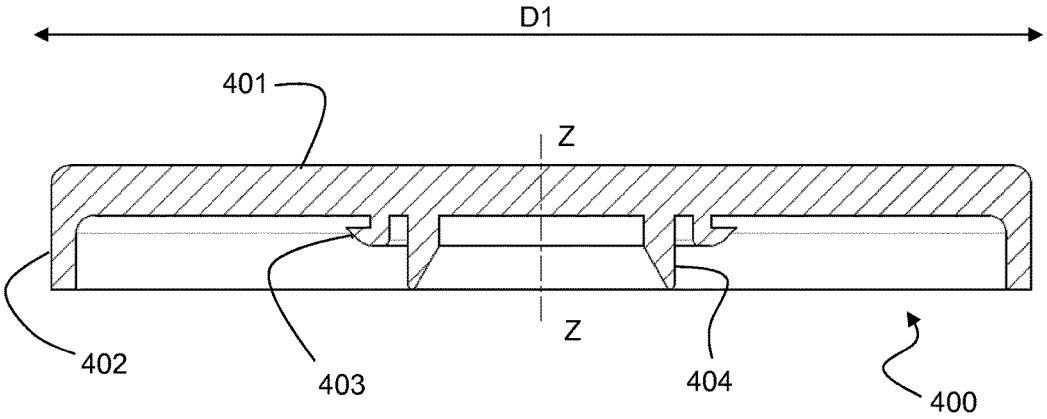
FIG. 6 shows a longitudinally sectioned view, on a larger scale, of a protection and sealing lid of the closure assembly according to FIGS. 2 and 3.

According to different known embodiments present on the market, a protection lid 400 is provided, said lid being joined together with the upper base 301 of the sealing nut, as shown in FIGS. 2, 3 and 6. The lid 400 can be removed from the sealing nut 300 by levering it upwards, even using only the fingers of one hand. The lid 400 is preferably made of plastic or thermoplastic material, such as polyethylene, polyethylene terephthalate, PETG or PEHD. When the lid is removed by the user a part of the top surface of the head of the sealing cap, defined by means of the hole 101' in the cage 100 and the hole 301' in the sealing nut 300, remains exposed. The sealing cap may thus be pierced, for example, by a needle of a syringe for introducing into the bottle a certain amount of a liquid (for example a solvent) and then drawing off the solvent together with the solute.

The lid 400 preferably comprises a circular plate 401 with a rim 402 shaped so as to enclose a part of the side wall 302 of the sealing nut 300. Preferably, the outer diameter D1 of the lid 400 is smaller than the diameter D of the bottle. The lid 400 preferably comprises an engaging part 403 for engaging with the edge of the central opening 301' of the upper base 301 of the sealing nut 300. The lid 400 may also comprise a further projection 404 designed to penetrate until it touches the head 210 of the sealing cap 200 in order to ensure that it remains clean and, if necessary, sterile at the piercing point.

With reference to FIG. 8 and FIGS. 2 and 3, one of the pluralities of ways with which the closure assembly may be assembled is now described. By way of example, the successive steps for joining the closure assembly together with the bottle (pre-assembly) and, finally, for closing in a sealed manner the bottle by means of the closure assembly of the invention, is now also described.

During the preparatory step fp-1 the sealing cap 200 is associated with the cage 100. Preferably, the sealing cap 200 is arranged with its shank directed upwards and the cage is placed with the open base 103 directed upwards in order to receive the head of the sealing cap 200. During insertion of the head of the cap, the retaining teeth 130 are retracted inside the respective recesses 131 and then snap-engage so as to retain the sealing cap 200 in position, as shown during the preparatory step fp-2.

Then (preparatory step fp-3), the cage 100 (with the sealing cap 200) is partially inserted inside the sealing nut 300. This step is preferably performed while still keeping the cage 100 (with the sealing cap 200) directed upwards. The cage 100 is only partially inserted into the sealing nut 300 so that that the annular fold 310 is seated inside the annular cavity 109'.

Preferably, before partially inserting the sealing nut 300 onto the cage 100, the lid 400 has already been associated with the sealing nut 300.

The closure assembly 1000, comprising the cage, the sealing cap 200, the sealing nut 300 and the lid 400 are collected in bags for sterilization.

Before or after the aforementioned preparatory steps, during a step f-1, the bottle is at least partially filled with a substance. This substance may be any substance in any state. For example, a pharmaceutical composition in the liquid, solid or other state.

During the step f-2 the closure assembly 1000 is fitted onto the bottle. Owing to the aforementioned special features of the various components, the closure assembly is stable on the open mouth 3 of the bottle. In fact, not only does the shank of the sealing cap penetrate into the open mouth, but the annular collar 4 is stably arranged between the lower annular relief 110 and the intermediate annular relief 120. In fact, the lower annular relief 110 and the intermediate annular relief 120 (in addition to the surface portion between them) form a seat which perfectly matches the shape of the collar 4 of the bottle 1. Therefore the shank of the cap provides a centering action and ensures retention, on the inside, of the bottle, while the annular reliefs 110 and 120 provide stability, on the outside, of the bottle. Moreover, owing to the engagement between the first lower annular fold 310 and the annular cavity 109', the sealing nut (with the cap mounted on it) is also stable with respect to the cage.

Advantageously, as can be seen from FIG. 8, the outer diameter D1 of the lid 400 is smaller than the outer diameter D of the bottle 1. This is a very advantageous aspect since it allows the bottles to be positioned against each other. This optimizes the spaces and makes the bottles stable during the closing and sealing steps as well as during packaging, transportation and/or storage.

During the step f-3 the bottle and the closure assembly are substantially as in step f-2. This allows, during sublimation which occurs in the freeze-drying step, the part in gaseous form contained inside the bottle to escape. In fact, the air may be extracted through the split 221 in the leg of the closure cap 200 which communicates with the longitudinal cavity of the shank. The air is then channeled through the slits 106 of the cage 100. The vacuum creation operation is diagrammatically indicated by the arrows "V" in FIG. 8, step f-4.

During the step f-5 a direct pressure is exerted downwards on the lid and therefore on the entire closure assembly. In particular, the pressure P exerted is such as to cause the collar 4 of the bottle to come out of the seat defined by the annular reliefs 110 and 120. The closure assembly is displaced downwards by an amount X1 such that the annular relief 120 of the cage rests against the collar 4. The cage 100, in this position, is slightly deformed plastically, but the outer diameter of the cage, indicated by D2, is in any case smaller than or the same as the diameter D of the bottle. This is a very advantageous aspect because it allows the bottles to be positioned against each other without being damaged. This optimizes the spaces and makes the bottles stable during the closing, packaging, transportation and storage steps.

By exerting a greater pressure, the bottle is completely capped and sealed. The annular relief 120 of the cage stably engages with the bottom edge of the collar 4 of the bottle. The sealing nut is pressed to make contact against the upper base 101 of the cage so that the annular relief 310 rests against the knee 107 of the cage, ensuring total sealing of the assembly.

Step f-7 shows how the bottles may be arranged straight against each other.

FIGS. 9, 10, 11 and 12 shows a second embodiment of the closure assembly shown in FIGS. 2-8. The same reference numbers used for the first embodiment will be used and the detailed description will not be repeated. Essentially, the sole difference between the first embodiment and the variant relates to the sealing cap.

In particular, as can be understood by looking at FIGS. 9, 10 and 11, the cap 200 according to FIG. 11 is squatter since the shank 220 extends over a smaller length than the shank 220 of the first embodiment. Moreover, a split such as the split 221, connecting the hollow inside of the sealing cap with the outside, is not provided.

Moreover, the shank of the sealing cap 200 of the second embodiment terminates in a more accentuated tapering and in a radially outwardly projecting end portion 224 able to engage with a corresponding projection 4*d* of the open mouth of the bottle.

The ergonomic form of this type of cap alone allows coating with Teflon or similar material, this ensuring a product quality which nowadays cannot be achieved with the cap described in the first embodiment.

With reference to FIG. 12, compared to FIG. 8, it can noted that there are no substantial differences during the preparatory steps fp-1, fp-2 and fp-3 and during the initial steps f-1 and f-2. However, it can be noted that the closure assembly according to the second embodiment is supported only on the outside of the bottle, with the collar 4 inside the seat defined by the annular reliefs 110 and 120 and by the surface portion between them. In other words, unlike the first embodiment, the closure assembly is not supported by the sealing cap which, initially. does not penetrate inside the mouth of the bottle. Nevertheless, the closure assembly is any case straight and stable on the bottle and does not project radially from it. Also in the case of the cap according to the second embodiment, a vacuum may be created inside the bottle by extracting air through the slit between the tapering of the shank of the cap 200 and the open aperture of the bottle and through the slits of the cage. This type of cap may therefore be used equally well to seal any type of product: freeze-dried, liquid, powder, etc. Moreover, it is more economical than the cap proposed in the first embodiment, (except for the Teflon-coated version). As regards the rest, all the considerations made for the first embodiment apply to the second embodiment.

FIGS. 13-17 relate to a third embodiment of the closure assembly according to the present invention. In particular, FIG. 13 shows the assembly in a pre-assembly configuration, FIG. 14 shows the assembly in an intermediate configuration and FIG. 15 shows the assembly completely assembled and closed. FIGS. 16 and 17 show the lid and the sealing nut which are different from those of the other embodiments.

With reference initially to FIG. 17, the sealing nut comprises a body substantially in the form of an overturned cup with a substantially closed upper base 301, a side wall 302 and a lower base 303 which is open downwards. Preferably, the sealing nut 300 consists of thermoplastic material and is made by means of injection-molding as one piece. A suitable material is, for example, polyethylene, polyethylene terephthalate, PETG, PEHD or ABS (acrilonitrile butadiene styrene). Alternatively, a metallic material, such as aluminum or aluminum alloy, could be used.

Preferably, according to the third embodiment, the side wall 302 of the sealing nut 300 comprises a first, lower, annular protuberance 310 and a second, upper, annular protuberance 320 which form two respective annular constrictions with respect to the substantially cylindrical inner surface of the sealing nut 300. The stabilizing function of the annular protuberances 310, 320 is similar to that of the folds of the first embodiment.

Both the lower protuberance 310 and the upper protuberance 320 comprise a surface inclined towards the open lower base 303. The inclination of the inclined surface of the lower protuberance 310 is greater than that of the upper protuberance 320.

Preferably, the upper base 301 of the sealing nut comprises a central opening 301', which is advantageously substantially circular. In the proximity of the edge of the central opening 301' the thickness is smaller so as to provide the edge of the central opening 301' with greater elasticity. The edge of the opening 301' is shaped in a spout-like manner (FIG. 17).

The lid 400 of the third embodiment (FIG. 16) preferably comprises a circular plate 401 with a rim 402 shaped so as to enclose a part of the side wall 302 of the sealing nut 300. Preferably, the outer diameter D1 of the lid 400 is smaller than the diameter D of the bottle.

The lid 400 comprises preferably an engaging part 403 for engaging with the edge of the central opening 301' of the upper base 301 of the sealing nut 300. In the third embodiment, the engaging part 403 comprises a foot which extends circumferentially downwards with an annular heel 405. When the lid and the sealing nut are joined together, the spout-like edge engages with the annular heel 405. Advantageously, the lid 400 may be raised and separated from the sealing nut 300, but they cannot then be joined together again. This is a very important aspect which ensures that the bottle cannot be closed again. Initial joining together of the sealing nut 300 and the lid 400 may be performed merely by pressing (from the bottom upwards) the edge of the central opening 301' towards the lid 400. In other words, this joining action is performed before assembling the sealing nut 300 on the cage 100.

FIG. 13 shows the closure assembly in the pre-assembled condition. Advantageously the cage is stably mounted on the collar of the bottle. In fact, the first annular relief 110 and the second annular relief 120 are spaced so as to form a seat for a collar 4 of the bottle 1.

Moreover, the sealing nut 300 (joined together with the cap 400) is stably mounted on the cage since the lower protuberance 310 is inserted inside the annular cavity 109'.

Starting from the configuration shown in FIG. 13, by means of a first pressure exerted on the cage the configuration shown in FIG. 14 is assumed. In this configuration the relative position of the cage and the sealing nut is not varied.

By means of a further pressing action the closed configuration shown in FIG. 15 is reached.

In the third embodiment also, the sealing cap may be as shown in FIG. 7.

In general the closure assembly thus finished may be easily used, by performing a small modification, on all the filling and sealing machines which exist nowadays in the world market. The closure assembly, in fact, will be moved using the same structures (hopper, slides, etc.) which are used nowadays for conveying only the rubber cap for pre-assembly on the bottle, modifying only part of these structures depending on the format.

The closure assembly furthermore may be used on high-speed automatic machines and in particular, in connection with freeze-drying, it is possible to perform all the closing, sealing, washing and drying operations inside the chamber itself with a consequent reduction in costs, time, space, tools and personnel.

With the present closure assembly, finally, it is possible for any one to continue using their own sealing cap since the said assembly is suitable for receiving any type of rubber cap.

The invention claimed is:

1. An assembly for closing a bottle comprising:

a cage;

a closure cap; and a sealing nut; wherein:

the cage is substantially cup-shaped and comprises a side wall with an inner surface comprising a first annular relief and a second annular relief spaced to form a seat for a collar of the bottle;

the closure cap comprises a head and a shank, wherein the head comprises an upper surface and an opposite annular surface;

the sealing nut is cup-shaped and comprises a side wall;

the inner surface of the side wall of the cage comprises a retaining tooth for retaining in position the head of the closure cap along the annular surface;

the retaining tooth is cantilevered and is inclined with respect to the inner surface of the side wall of the cage;

at the retaining tooth a recess is provided within which the tooth can be retracted, so that the head of the sealing cap can be pushed towards the base of the cage;

the outer surface of the side wall of the cage comprises an annular cavity;

the side wall of the sealing nut comprises an inner lower protuberance configured to engage with the annular cavity in a preassembly configuration; and the side wall of the cage comprises a plurality of discrete side walls, each separated by a slit, wherein a discrete side wall is connected to an adjoining discrete side wall with a bridge-piece in proximity of their free end.

2. An assembly according to claim 1, wherein four retaining teeth and four respective recesses are provided.

3. An assembly according to claim 1, wherein a free end of the discrete side walls has a beveled shape.

4. An assembly according to claim 1, wherein the sealing cap is configured such that the shank is at least partially inserted into the mouth of the bottle when the bottle collar is between the first annular relief and the second annular relief.

5. An assembly according to claim 1, further comprising a lid including an engaging part for engaging with an edge of a central opening in the upper base of the sealing nut.

6. An assembly according to claim 5, wherein the engaging part comprises a foot with an annular heel.

7. An assembly according to claim 1, wherein the sealing nut comprises a free edge and wherein the free edge is folded so as to form a rounded edge.

8. An assembly according to claim 1, wherein the sealing nut comprises a metal foil and the inner lower protuberance comprises a first annular fold which forms an annular restriction with respect to a substantially cylindrical inner surface of the sealing nut.

9. A bottle comprising a closure assembly according to claim 1.

10. A bottle according to claim 9, wherein the outer diameter of the bottle is greater than the outer diameter of the sealing assembly.

11. A method for assembling a closure assembly of a bottle and for mounting the closure assembly on a mouth of the bottle, the method comprising:

providing a cage, a closure cap, and a sealing nut; wherein the cage is substantially cup-shaped and comprises a side wall with an inner surface comprising a first annular relief and a second annular relief spaced to form a seat for a collar of the bottle;

the closure cap comprises a head and a shank, wherein the head comprises an upper surface and an opposite annular surface;

the sealing nut is cup-shaped and comprises a side wall;

the inner surface of the side wall of the cage comprises a retaining tooth for retaining in position the head of the closure cap along the annular surface;

the retaining tooth is cantilevered and is inclined with respect to the inner surface of the side wall of the cage;

at the retaining tooth a recess is provided within which the tooth can be retracted, the outer surface of the side wall of the cage comprises an annular cavity;

the side wall of the sealing nut comprises an inner lower protuberance configured to engage with the annular cavity, the side wall of the cage comprises a plurality of discrete side walls, each separated by a slit, wherein a discrete side wall is connected to an adjoining discrete side wall with a bridge-piece in the proximity of their free end;

pushing the head of the sealing cap towards the base of the cage;

partially fitting the sealing nut on the cage, so that the inner lower protuberance engages with the annular cavity;

mounting the cage on the bottle so that the collar of the bottle abuts between the first annular relief and the second annular relief.

12. The method according to claim 11, further comprising providing a lid and joining the lid together with the sealing nut.

13. The method according to claim 12, wherein the joining the lid together with the sealing nut is performed before partially fitting the sealing nut onto the cage.

* * * * *